US006253849B1

(12) United States Patent
Newman

(10) Patent No.: US 6,253,849 B1
(45) **Date of Patent: *Jul. 3, 2001**

(54) METHOD OF DISTINGUISHING THE RAISING AND LOWERING OF TUBING AND SUCKER RODS

(75) Inventor: Frederic M. Newman, Midland, TX (US)

(73) Assignee: Newman Family Partnership, Ltd.

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/534,599

(22) Filed: Mar. 27, 2000

Related U.S. Application Data

(62) Division of application No. 09/058,477, filed on Apr. 10, 1998, now Pat. No. 6,079,490.

(51) Int. Cl.[7] ..... E21B 47/01

(52) U.S. Cl. ..... 166/255.1; 166/64; 166/66

(58) Field of Search ..... 166/255.1, 250.01, 166/53, 64, 66; 73/152.43, 152.45

(56) References Cited

U.S. PATENT DOCUMENTS

| | | | | |
|---|---|---|---|---|
| 4,434,971 | * | 3/1984 | Cordrey | 254/273 |
| 4,545,017 | * | 10/1985 | Richardson | 364/422 |
| 4,604,724 | * | 8/1986 | Shaginian et al. | 364/478 |
| 5,216,638 | * | 6/1993 | Wright | 367/35 |

* cited by examiner

*Primary Examiner*—William Neuder
*Assistant Examiner*—Zakiya Walker
(74) *Attorney, Agent, or Firm*—Robert J. Harter

(57) ABSTRACT

A self-contained mobile repair unit for repairing wells includes the hydraulic and pneumatic tooling required to do a variety of jobs including the installation and removal of an inner pipe string, sucker rods and a pump. The repair unit, hydraulic tooling and pneumatic tooling share a common engine and a common process monitor. Access to data gathered by the monitor is restricted at the job site itself. Instead, the data is transmitted to a remote home base for the purpose of monitoring operations form a central location.

19 Claims, 10 Drawing Sheets

METHOD OF DISTINGUISHING THE RAISING AND LOWERING OF TUBING AND SUCKER RODS

CROSS-REFERENCE TO RELATED APPLICATION

This application is a division of application Ser. No. 09/058,477 filed on Apr. 10, 1998, now U.S. Pat. No. 6,079,490.

BACKGROUND OF THE INVENTION

1. Field Of The Invention

The subject invention generally pertains to equipment used for repairing wells that have already been drilled, and more specifically pertains to mobile repair units that frequently travel from one site to another.

2. Description Of Related Art

After an oil rig drills a well and installs the well casing, the rig is dismantled and removed from the site. From that point on, a mobile repair unit is typically used to service the well. Servicing includes installing and removing inner tubing strings, sucker rods, and pumps. The variety of work requires a myriad of tools. When the tooling is not closely associated with the mobile repair unit, the right equipment may not be available when needed.

Moreover, the work is carried out by a company that typically owns and operates several mobile repair units. The units are often operating at the same time at various remote sites. Some sites may be separated by hundreds of miles. This makes it difficult to stay abreast of the status at each of the sites.

Typically, a supervisor will travel from site to site. However, this is inefficient and often critical steps of an operation get carried out unsupervised. At times, accidents occur in the absence of an unbiased witness.

SUMMARY OF THE INVENTION

To avoid the problems of today's mobile repair units, a first object of the invention is to closely associate hydraulic and pneumatic systems with a mobile repair unit by having them share a common power supply and monitoring system.

A second object of the invention is to provide a remotely accessible mobile repair unit with the necessary equipment to make it universally adaptable to do a variety of work such as removing and installing an inner tubing string, sucker rods, and pumps.

A third object is to provide a mobile repair unit that senses and transmits, to a remote home base, data that identifies the extent to which an inner tubing string was stretched prior to flooding the well bore with fluid.

A fourth object is to identify from a remote location key events, such as the time of transition of installing steel sucker rods to installing fiberglass ones.

A fifth object is to restrict local operator access to a system that monitors the operation of a mobile repair unit so an unbiased and unaltered record can be recorded and maintained of the complete system and activity of the mobile repair unit.

A sixth object is to convey to a remote location a record that helps explain events that led to an accident at the work site. When the information is conveyed to a remote site, it is not likely to be destroyed by the accident itself, such as a fire.

A seventh object is to remotely identify an imbalance of a mobile repair unit caused by wind or leaning inner tubing segments against its derrick.

An eighth object is to remotely distinguish between the raising and lowering of an inner tubing string to help establish the cause of an accident. An added benefit is to be able to place the proper predetermined tension on a packer or tubing anchor being set.

A ninth object is to enable one to remotely identify when a mobile repair unit is operating for the purpose of determining the amounts to be invoiced for the work performed.

A tenth object is to provide a method of alerting a home base of a hazardous level of hydrogen sulfide gas present at a remote work site.

These and other objects of the invention are provided by a self-contained mobile repair unit having a universal set of hydraulic and pneumatic tooling for servicing well equipment such as an inner pipe string, a sucker rod and a pump. The repair unit and tooling share a common engine. An extendible derrick supporting a hoist is pivotally coupled to the frame of the repair unit. A monitor senses the load on the derrick and conveys that information to a remote home base where the time of critical events is identified.

DESCRIPTION OF THE PREFERRED EMBODIMENT

Figure 1:
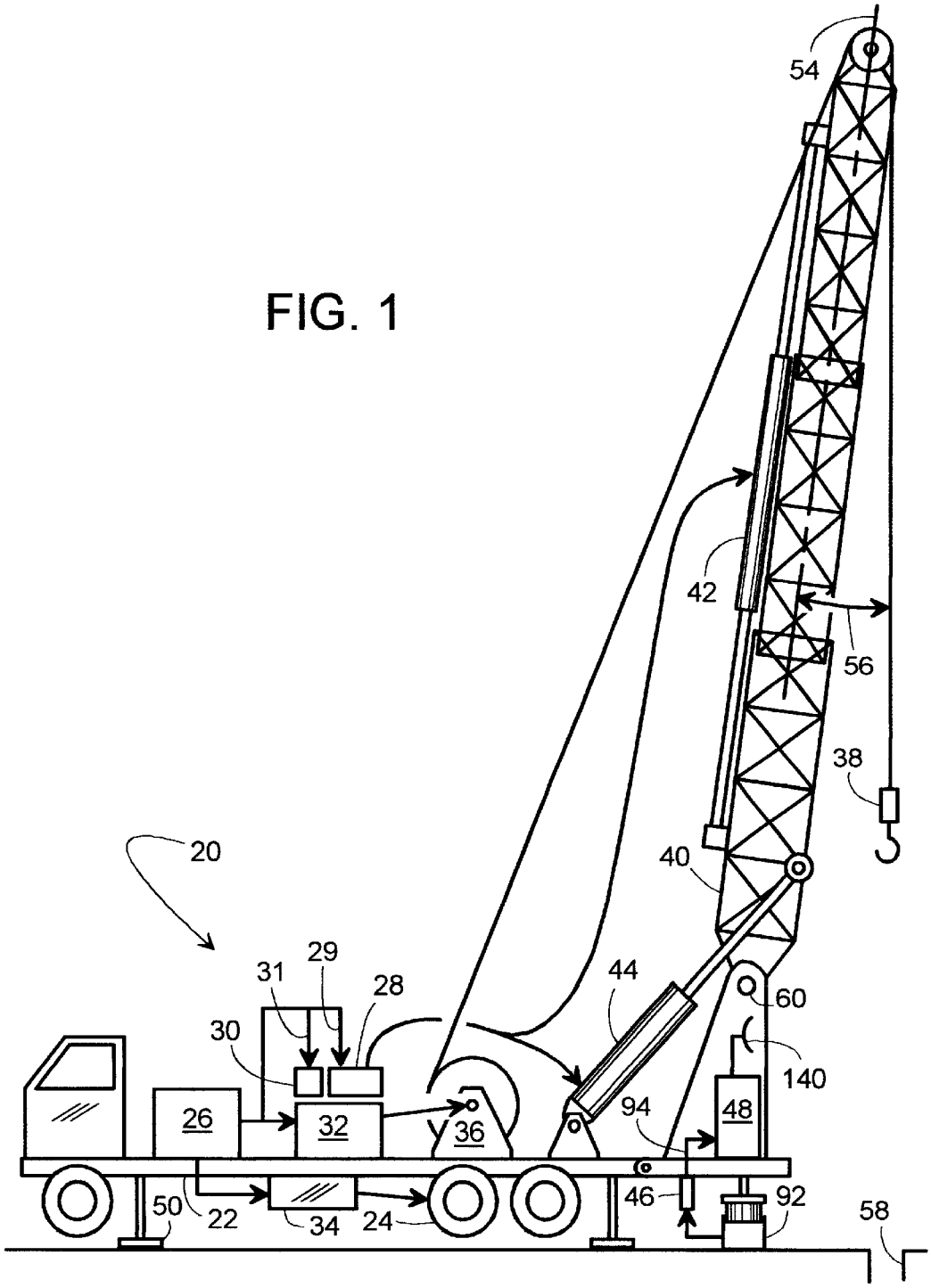
FIG. 1 is a side view of a mobile repair unit with its derrick extended.

Referring to FIG. 1, a retractable, self-contained mobile repair unit 20 is shown to include a truck frame 22 supported on wheels 24, an engine 26, a hydraulic pump 28, an air compressor 30, a first transmission 32, a second transmission 34, a variable speed hoist 36, a block 38, an extendible derrick 40, a first hydraulic cylinder 42, a second hydraulic cylinder 44, a first transducer 46, a monitor 48, and retractable feet 50.

Figure 4:
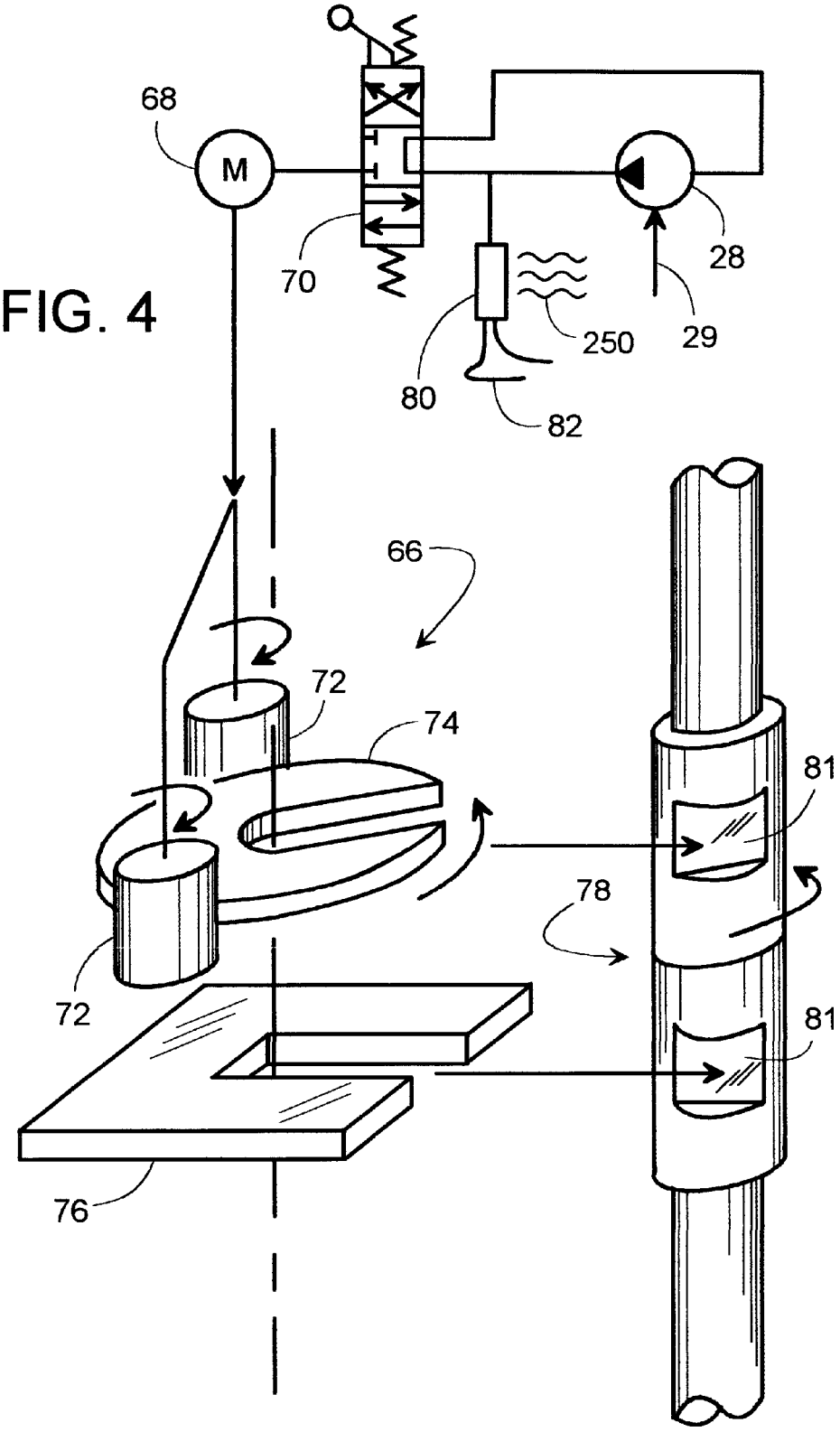
FIG. 4 is a schematic illustration of a set of hydraulic tongs.
Figure 5:
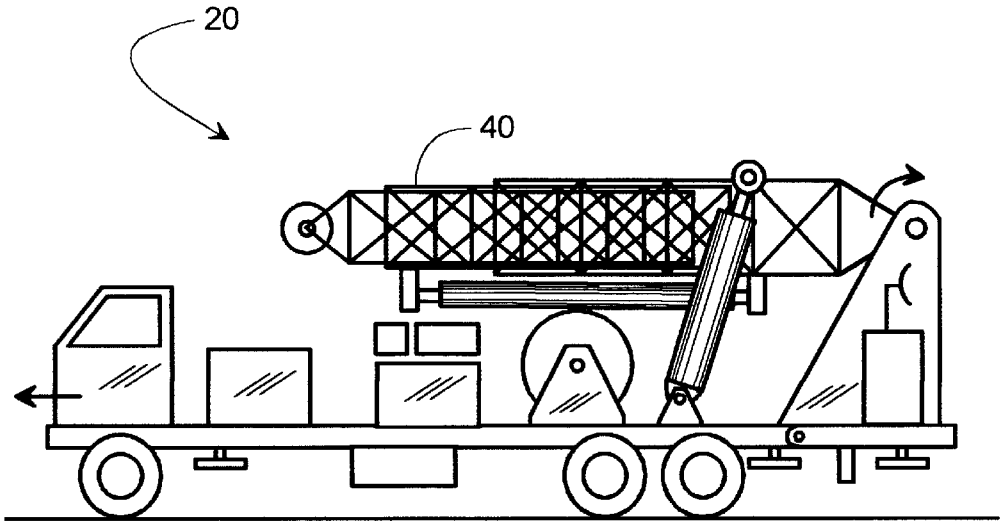
FIG. 5 is a side view of a mobile repair unit with its derrick retracted.
Figure 16:
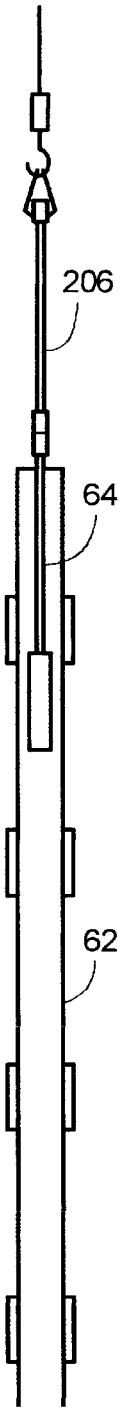
FIG. 16 shows a second steel sucker rod being lowered into an inner tubing string.
Figure 17:
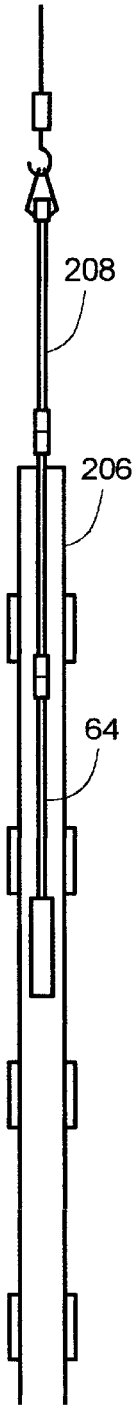
FIG. 17 shows a first fiberglass sucker rod being lowered into an inner tubing string.
Figure 18:
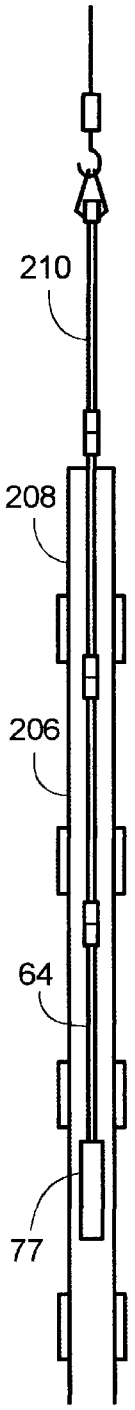
FIG. 18 shows a second fiberglass sucker rod being lowered into an inner tubing string.

Engine 32 selectively couples to wheels 24 and hoist 36 by way of transmissions 34 and 32, respectively. Engine 26 also drives hydraulic pump 28 via line 29 and air compressor 30 via line 31. Compressor 30 powers a pneumatic slip 84 (FIGS. 2 and 3), and pump 28 powers a set of hydraulic tongs 52 (FIG. 4). Pump 28 also powers cylinders 42 and 44 which respectively extend and pivot derrick 40 to selectively place derrick 40 in a working position (FIG. 1) and in a lowered position (FIG. 5). In the working position, derrick 40 is pointed upward, but its longitudinal centerline 54 is angularly offset from vertical as indicated by angle 56. The angular offset provides block 38 access to a well bore 58 without interference with derrick pivot point 60. With angular offset 56, the derrick framework does not interfere with the typically rapid installation and removal of numerous inner pipe segments (known as an innerpipe string 62) and sucker rods 64 (FIG. 16).

Individual pipe segments (of string 62) and sucker rods 64 are screwed to themselves using hydraulic tongs 66 which are schematically illustrated in FIG. 4. The term "hydraulic tongs" used herein and below refer to any hydraulic tool that can screw together two pipes or sucker rods. An example would include those provided by B. J. Hughes company of Houston, Tex. In operation, pump 28 drives a hydraulic motor 68 forward and reverse by way of valve 70. Conceptually, motor 68 drives pinions 72 which turn wrench element 74 relative to clamp 76. Element 74 and clamp 76 engage flats 81 on mating couplings 78 of a sucker rod or inner pipe string of one conceived embodiment of the invention. However, it is well within the scope of the invention to have rotational jaws or grippers that clamp on to a round pipe (i.e., no flats) similar in concept to a conventional pipe wrench, but with hydraulic clamping. The rotational direction of motor 68 determines assembly or disassembly of couplings 78. Transducer 80 is used to provide a 0–5 VDC signal 82 that in one embodiment of the invention indicates the applied torque to couplings 78.

Figure 2:
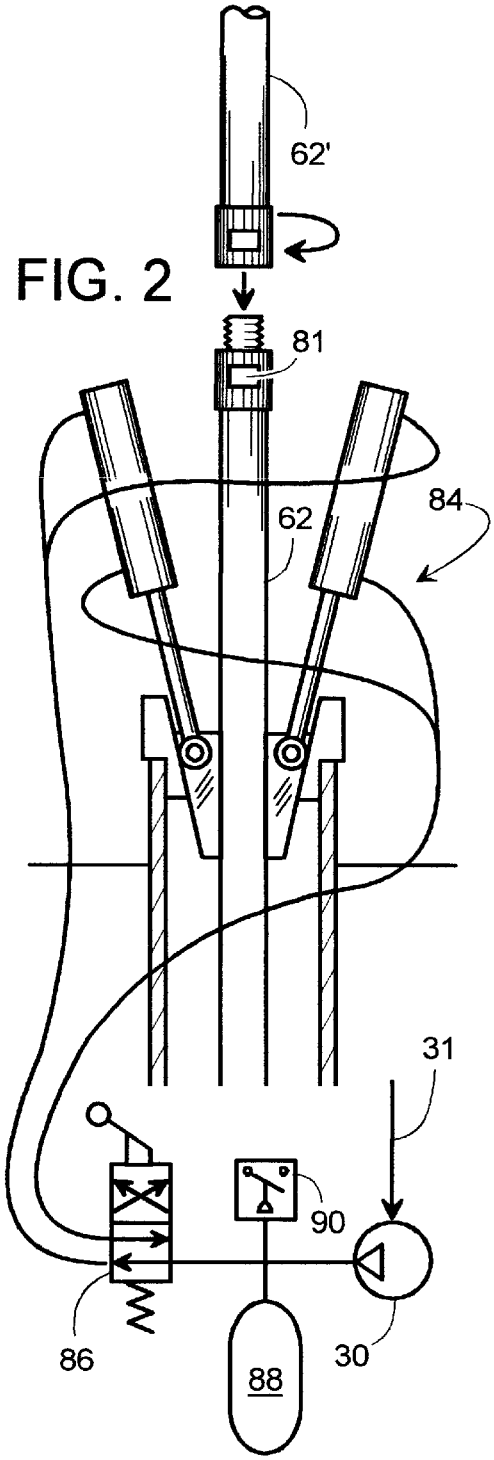
FIG. 2 is a schematic view of a pneumatic slip in a locked position.
Figure 3:
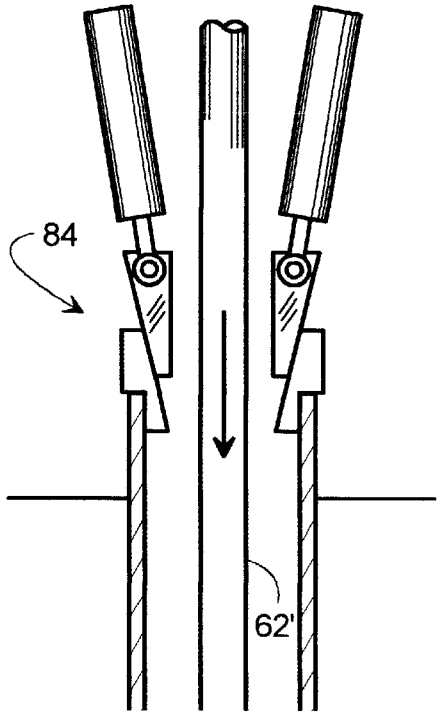
FIG. 3 is a schematic view of a pneumatic slip in an open position.

Referring to FIGS. 2 and 3, when installing inner pipe string 62, pneumatic slip 84 is used to hold pipe string of pipe 62 while the next segment 62' is screwed on using tongs 66. Compressor 30 provides pressurized air through valve 86 to rapidly clamp and release slip 84 (FIGS. 2 and 3, respectively). A tank 88 helps maintain a constant air pressure. Pressure switch 90 provides monitor 48 with a signal that indirectly indicates that repair unit 20 is in operation.

Figure 6:
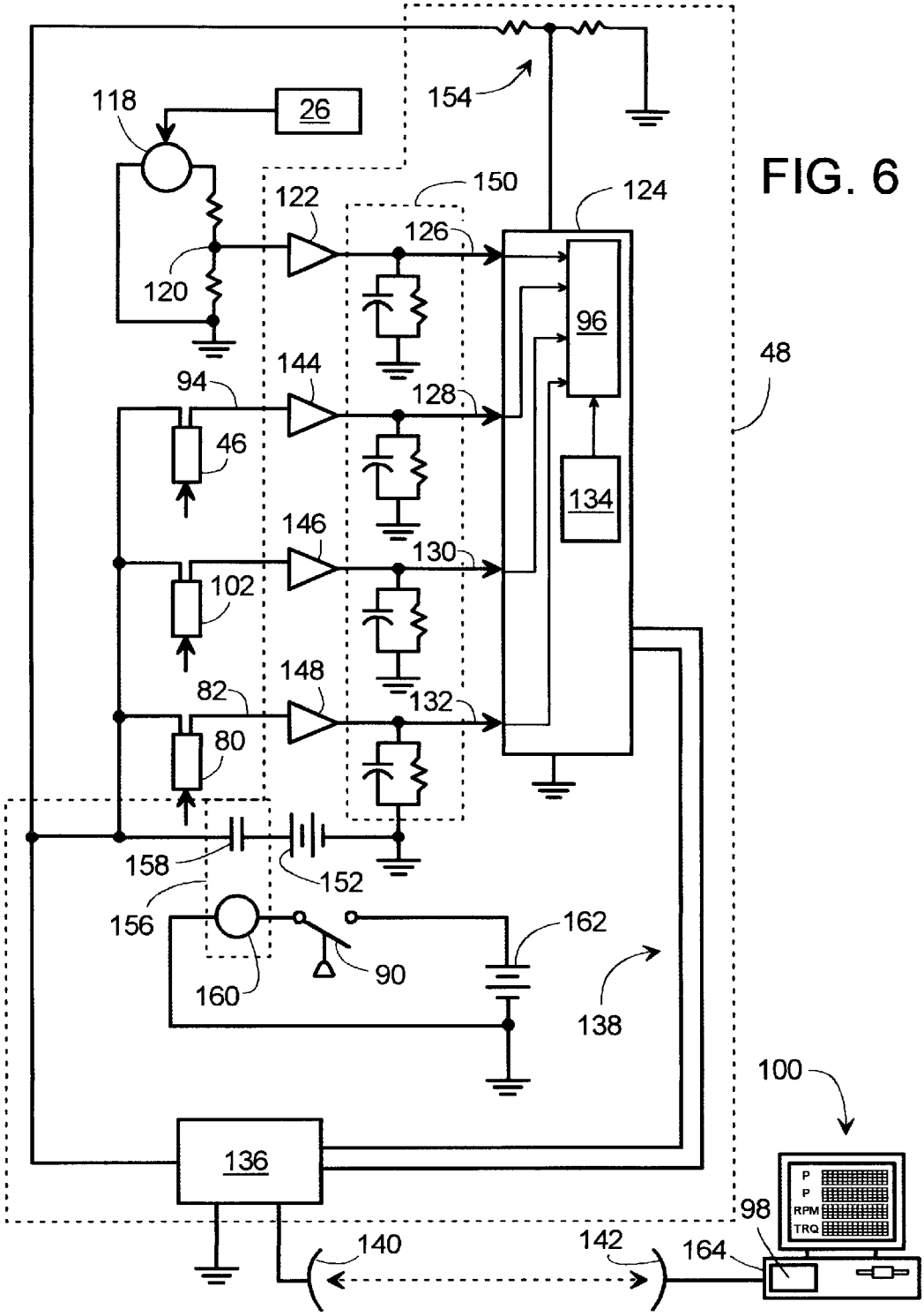
FIG. 6 is an electrical schematic of a monitor circuit.

Referring back to FIG. 1, weight applied to block 38 is sensed by way of a hydraulic pad 92 that supports the weight of derrick 40. Hydraulic pad 92 is basically a piston within a cylinder (alternatively a diaphragm) such as those provided M. D. Totco company of Cedar Park, Tex. Hydraulic pressure in pad 92 increases with increasing weight on block 38. In FIG. 6, first transducer 46 converts the hydraulic pressure to a 0–5 VDC signal 94 that is conveyed to monitor 48. Monitor 48 converts signal 94 to a digital value, stores it in a memory 96, associates it with a real time stamp, and eventually communicates the data to a remote home base 100 by way of a modem 98.

Figure 7:
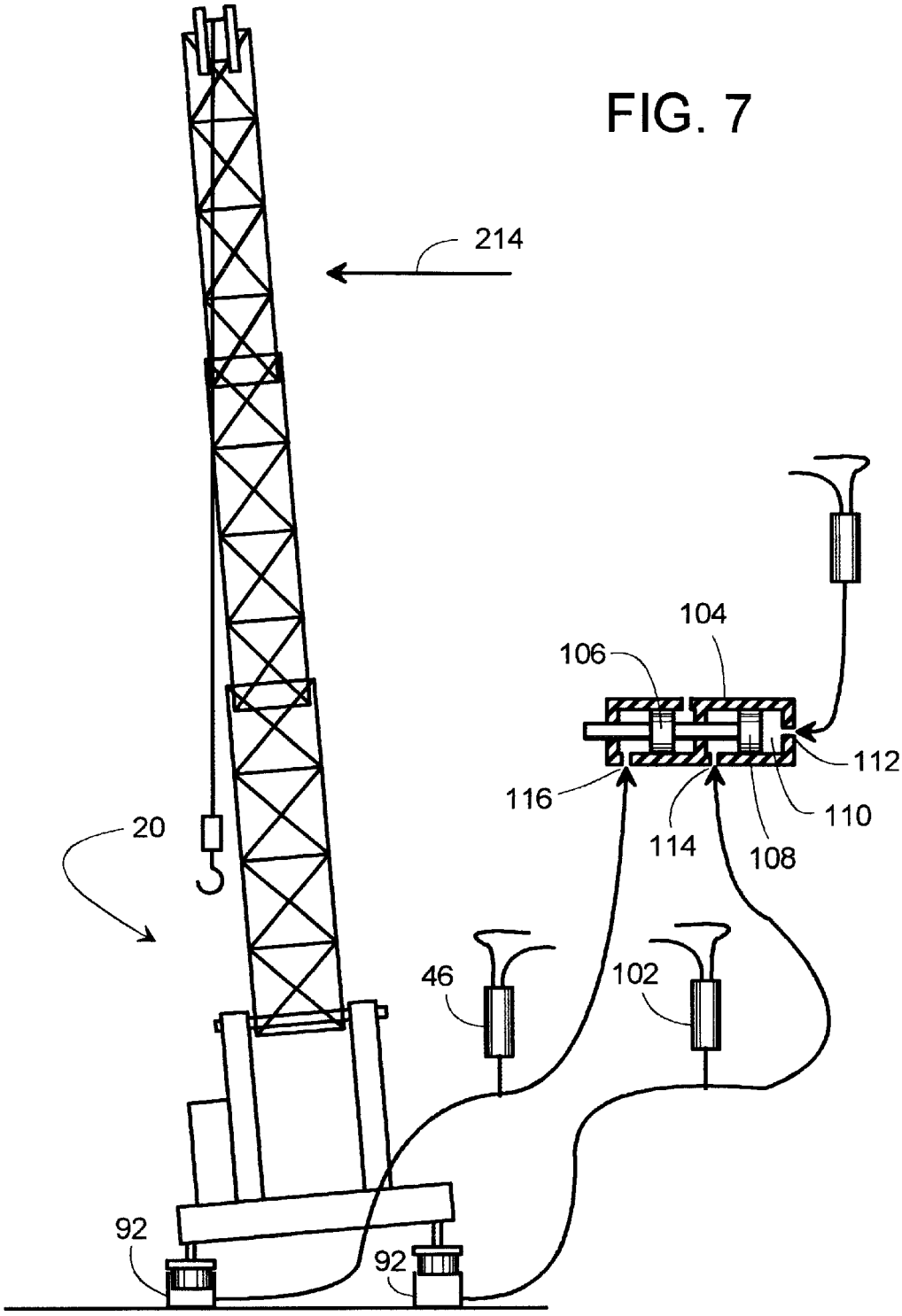
FIG. 7 is an end view of an imbalanced derrick.

In the embodiment of FIG. 7, two pads 92 associated with two transducers 46 and 102 are used. An integrator 104 separates pads 92 hydraulically. The rod side of pistons 106 and 108 each have a pressure exposed area that is half the full face area of piston 108. Thus chamber 110 develops a pressure that is an average of the pressures in pads 92. One type of integrator 104 is provided by M. D. Totco company of Cedar Park, Tex. In one embodiment of the invention, just one transducer 46 is used and it is connected to port 112. In another embodiment of the invention, two transducers 46 and 102 are used, with transducer 102 on the right side of unit 20 coupled to port 114 and transducer 46 on the left side coupled to port 116. Such an arrangement allows one to identify an imbalance between the two pads 92.

Returning to FIG. 6, transducers 46 and 102 are shown coupled monitor 48. Transducer 46 indicates the pressure on left pad 92 and transducer 102 indicates the pressure on the right pad 92. A generator 118 driven by engine 26 provides an output voltage proportional to the engine speed. This output voltage is applied across a dual-resistor voltage divider to provide a 0–5 VDC signal at point 120 and then passes through an amplifier 122. Generator 118 represents just one of many various tachometers that provide a feedback signal proportional to the engine speed. Another example of a techometer would be to have engine 26 drive an alternator and measure its frequency. Transducer 80 provides a signal proportional to the pressure of hydraulic pump 28, and thus proportional to the torque of tongs 66.

A telephone accessible circuit 124, referred to as a "POCKET LOGGER" by Pace Scientific, Inc. of Charlotte, N.C., includes four input channels 126, 128, 130 and 132; a memory 96 and a clock 134. Circuit 124 periodically samples inputs 126, 128, 130 and 132 at a user selectable sampling rate; digitizes the readings; stores the digitized values; and stores the time of day that the inputs were sampled. It should be appreciated by those skilled in the art that with the appropriate circuit, any number of inputs can be sampled. Page Scientific provides circuits that employ multiplexing to provide twelve input channels.

An operator at a home base 100 remote from the work site at which repair unit 20 is operating accesses the data stored in circuit 124 by way of a PC-based modem 98 and a cellular phone 136. Phone 136 reads the data stored in circuit 124 via lines 138 (RJ11 telephone industry standard) and transmits the data to modem 98 by way of antennas 140 and 142. In one embodiment of the invention, phone 136 includes a CELLULAR CONNECTIONTM™ provided by Motorola Incorporated of Schaumburg, Ill. (a model S1936C for Series II cellular transceivers and a model S1688E for older cellular transceivers).

Some details worth noting about monitor 48 is that its access by way of a modem makes monitor 48 relatively inaccessible to the crew at the job site itself. Amplifiers 122, 144, 146 and 148 condition their input signals to provide corresponding inputs 126, 128, 130 and 132 having an appropriate power and amplitude range, Sufficient power is needed for RC circuits 150 which briefly (e.g., 2–10 seconds) sustain the amplitude of inputs 126, 128, 130 and 132 even after the outputs from transducers 46, 102 and 80 and the output of generator 118 drop off. This ensures the capturing of brief spikes without having to sample and store an excessive amount of data. A DC power supply 152 provides a clean and precise excitation voltage to transducers 46, 102 and 80; and also supplies circuit 24 with an appropriate voltage by way of voltage divider 154. Pressure switch 90 enables power supply 152 by way of relay 156 whose contacts 158 close by coil 160 being energized by battery 162.

Figure 8:
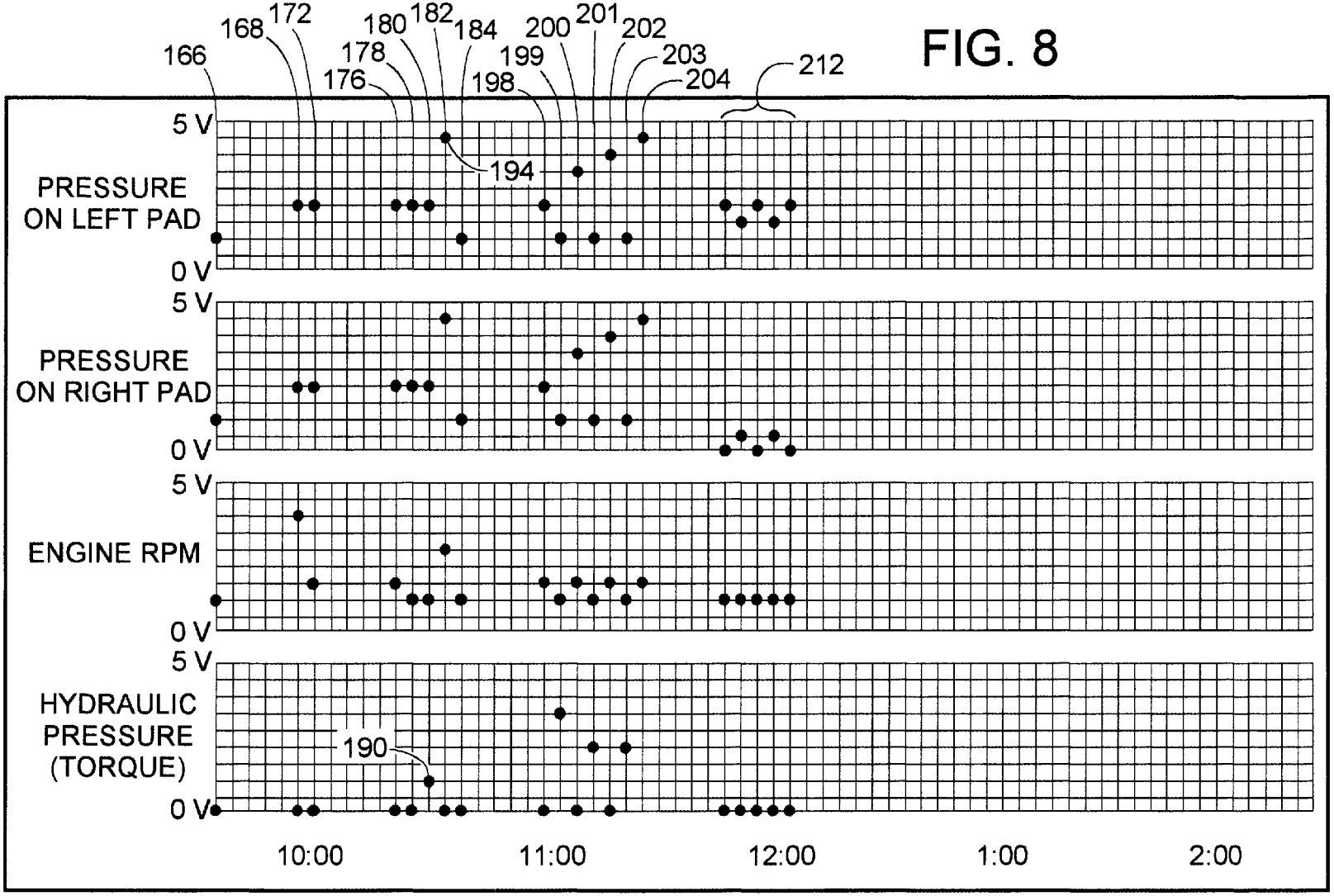
FIG. 8 shows digital data associated with a time stamp.
Figure 9:
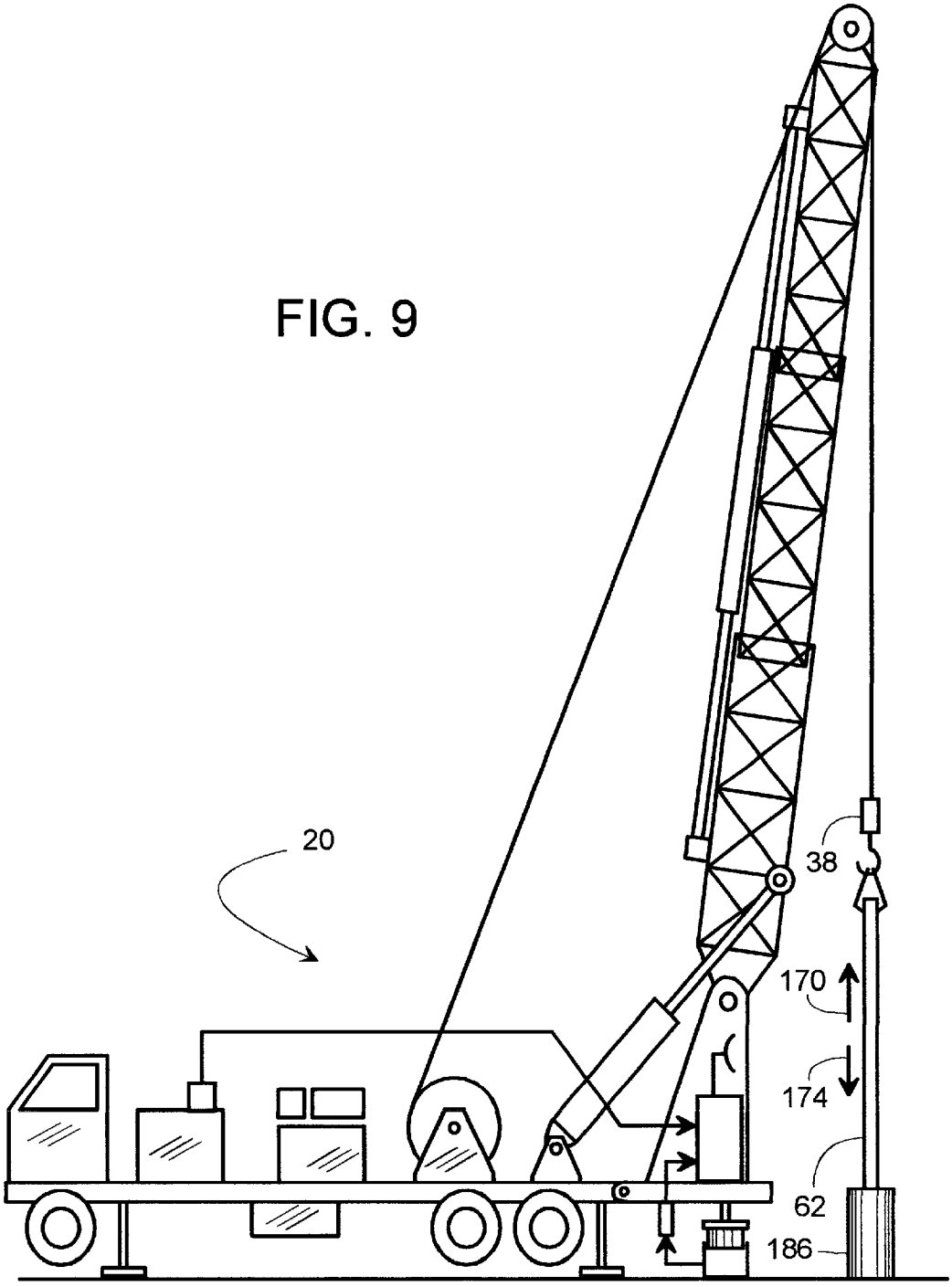
FIG. 9 illustrates the raising and lowering of an inner tubing string.
Figures 10, 11, 12, 13, 14:
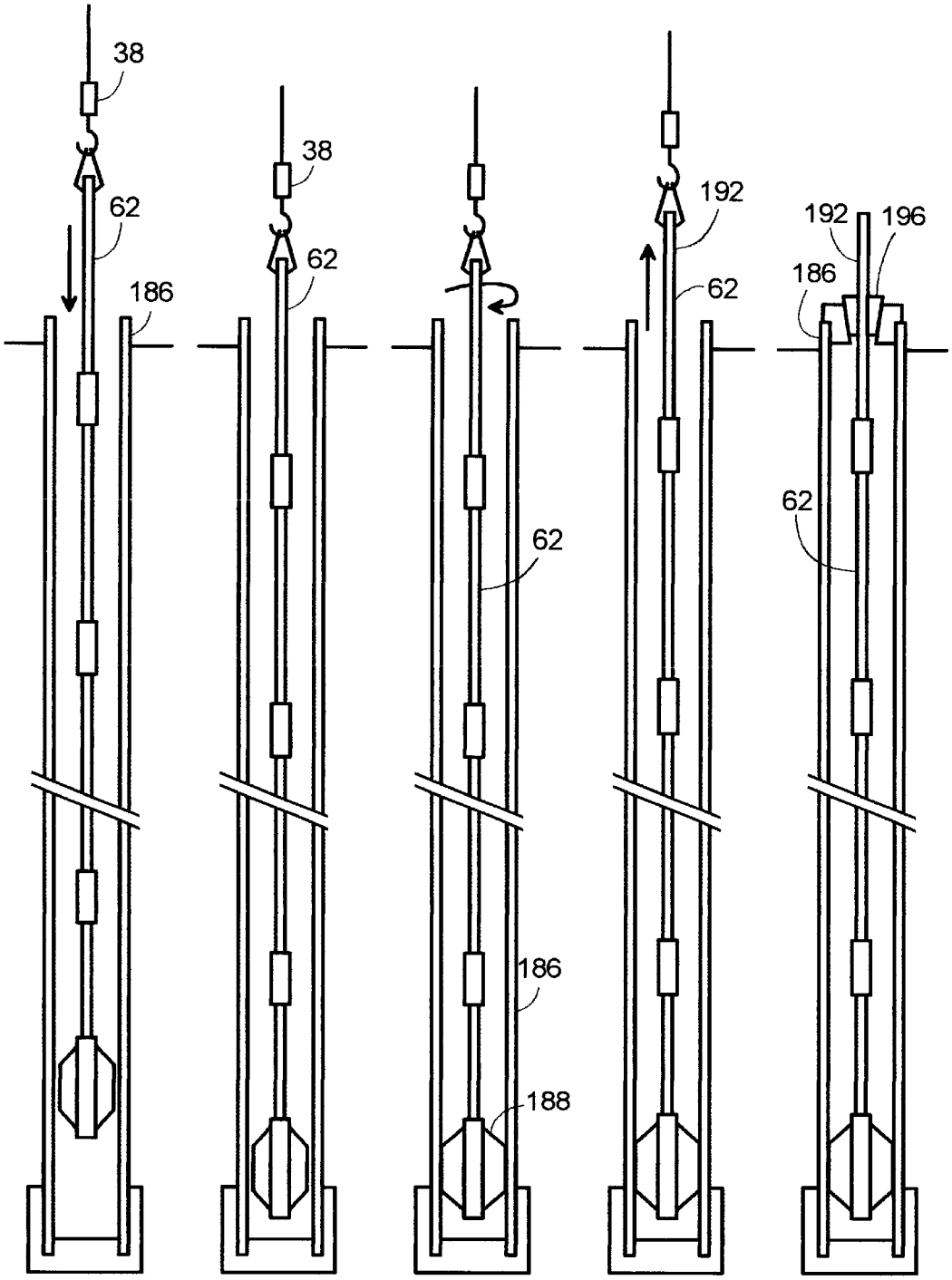
FIG. 10 shows an inner tubing being lowered.
FIG. 11 shows an inner tubing stopped at a predetermined depth.
FIG. 12 shows an inner tubing being locked in a conventional manner to another casing.
FIG. 13 shows an inner tubing being stretched.
FIG. 14 shows pre-stretched inner tubing locked within an outer casing.
Figure 15:
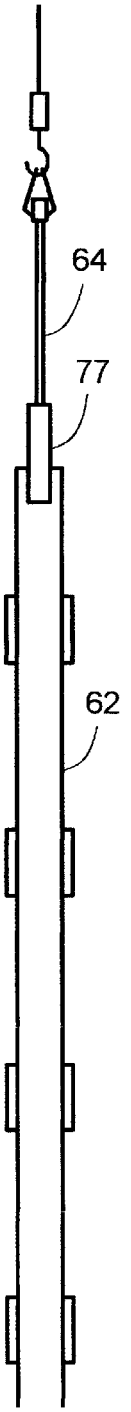
FIG. 15 shows a first steel sucker rod (with a pump) being lowered into an inner tubing string.

FIG. 8 shows an example of the data extracted from circuit 124 and remotely displayed at PC 164. The values plotted at a point in time indicated by numeral 166 represent repair unit 20 at rest with engine 26 idling as shown in FIG. 1. Numeral 168 showing weight on block 38 and high engine speed indicates the raising of an inner pipe string 62 as represented by arrow 170 of FIG. 9. Numeral 172 showing weight on block 38 and low engine speed indicates the lowering of inner pipe string 62 as represented by arrow 174 of FIG. 9. Points 176, 178, 180, 182 and 184 correspond to the conditions illustrated in FIGS. 10, 11, 12, 13 and 14, respectively. In FIG. 10, an inner pipe string 62 is being lowered into an outer casing 186. In FIG. 11, tubing string is stopped at a predetermined depth. In FIG. 12 pipe string 62 is rotated in a conventional manner to lock its lower end 188 to outer casing 186 (note slight torque at point 190). In FIG. 13 an upper end 192 of string 62 is raised until the pressure parameter at right and left pads 92 reach the predetermined limit indicated by numeral 194. In FIG. 14 wedge 196 locks upper end 192 to casing 186, and block 38 is disconnected from pipe string 62. Points 198, 200, 202 and 204 correspond to the conditions illustrated in FIGS. 15, 16, 17 and 18, respectively, which depict the lowering of a string of sucker rods having a pump 77 at its lower end. Intermediate points 199, 201 and 203 indicate tongs 66 screwing onto the first steel sucker rod 64 a second steel sucker rods 206, a fiberglass sucker rod 208, and a second fiberglass sucker rod 210, respectively. Note the difference in torque and the incremental weight difference at pads 92 when changing over from steel rods to fiberglass ones. Points 212 correspond to the windy conditions illustrated by arrow 214 of FIG. 7. The absence of data points beyond 12:00 indicates that the windy conditions prevented the crew from continuing, or it was Friday afternoon.

Referring back to FIG. 4, it should be noted that transducer 80 represents any one of a variety of devices that produce an electrical signal in response to a change in a sensed condition. In one embodiment of the invention, transducer 80 is actually a hydrogen sulfide gas detector with signal 82 serving as a gas detection signal that varies with a varying concentration of hydrogen sulfide gas 250. An example of a hydrogen sulfide gas detector is a CONTROLLER 8000 provided by Industrial Scientific Corporation of Oakdale, Pa.

Although the invention is described with respect to a preferred embodiment, modifications thereto will be apparent to those skilled in the art. Therefore, the scope of the invention is to be determined by reference to the claims which follow.

I claim:

1. A method of distinguishing from a location remote from a well site the raising and lowering of a threaded elongated member by a mobile repair unit at the well site, said method comprising the steps of:

applying a variable downward force to a hoist system by suspending said threaded elongated member therefrom, said hoist system including a derrick having a longitudinal centerline;

tilting said derrick to place said longitudinal centerline at an angle relative to vertical;

by way of said hoist system, selectively raising and lowering said threaded elongated member along a substantially vertical path;

monitoring a first parameter that changes upon said hoist system changing from raising to lowering of said threaded elongated member;

monitoring a second parameter that varies as a function of said downward force;

storing a first digital value representing said first parameter;

storing a second digital value representing said second parameter;

communicating said first digital value and said second digital value to said location; and comparing, at said remote location, said first digital value with said second digital value, whereby said first digital value indicates raising and lowering, while said second digital value indicates said threaded elongated member is coupled to said hoist system.

2. The method of claim 1, wherein said threaded elongated member is a sucker rod.

3. The method of claim 1, wherein said threaded elongated member is a pipe segment.

4. The method of claim 1, wherein said step of communicating said first digital value and said second digital value to said location involves the use of wireless communication.

5. The method of claim 1, wherein said step of communicating said first digital value and said second digital value to said location involves the use of a modem.

6. The method of claim 1, wherein said step of communicating said first digital value and said second digital value to said location involves the use of a cell phone.

7. The method of claim 1, wherein said hoist system includes an engine that powers said hoist system, and said first parameter varies as a function of a rotational speed of said engine.

8. The method of claim 1, further comprising storing a third value representing a time of day indicative of when at least one of said first parameter and said second parameter is monitored.

9. A method of distinguishing from a location remote from a well site the raising and lowering of a threaded elongated member by a mobile repair unit at the well site, said method comprising the steps of:

applying a variable downward force to a hoist system by suspending said threaded elongated member therefrom, said hoist system including a derrick having a longitudinal centerline;

tilting said derrick to place said longitudinal centerline at an angle relative to vertical;

by way of said hoist system, selectively raising and lowering said threaded elongated member along a substantially vertical path;

monitoring a first parameter that changes upon said hoist system changing from raising to lowering of said threaded elongated member;

monitoring a second parameter that varies as a function of said downward force;

storing a first digital value representing said first parameter;

storing a second digital value representing said second parameter;

storing a third value representing a time of day indicative of when at least one of said first parameter and said second parameter is monitored.

communicating said first digital value and said second digital value to said location; and comparing, at said remote location, said first digital value with said second digital value, whereby said first digital value indicates raising and lowering, while said second digital value indicates said threaded elongated member is coupled to said hoist system.

10. The method of claim 9, wherein said threaded elongated member is a sucker rod.

11. The method of claim 9, wherein said threaded elongated member is a pipe segment.

12. The method of claim 9, wherein said step of communicating said first digital value and said second digital value to said location involves the use of wireless communication.

13. The method of claim 9, wherein said step of communicating said first digital value and said second digital value to said location involves the use of a modem.

14. The method of claim 9, wherein said step of communicating said first digital value and said second digital value to said location involves the use of a cell phone.

15. The method of claim 9, wherein said hoist system includes an engine that powers said hoist system, and said first parameter varies as a function of a rotational speed of said engine.

16. A method of distinguishing from a location remote from a well site the raising and lowering of a threaded elongated member by a mobile repair unit at the well site, said method comprising the steps of:

applying a variable downward force to a hoist system by suspending said threaded elongated member therefrom, said hoist system including a derrick having a longitudinal centerline;

tilting said derrick to place said longitudinal centerline at an angle relative to vertical;

by way of said hoist system, selectively raising and lowering said threaded elongated member along a substantially vertical path;

monitoring a first parameter that changes upon said hoist system changing from raising to lowering of said threaded elongated member;

monitoring a second parameter that varies as a function of said downward force;

storing a first digital value representing said first parameter;

storing a second digital value representing said second parameter;

storing a third value representing a time of day indicative of when at least one of said first parameter and said second parameter is monitored communicating through a wireless communication link said first digital value and said second digital value to said location; and comparing, at said remote location, said first digital value with said second digital value, whereby said first digital value indicates raising and lowering, while said second digital value indicates said threaded elongated member is coupled to said hoist system.

17. The method of claim 16, wherein said step of communicating said first digital value and said second digital value to said location involves the use of a modem.

18. The method of claim 16, wherein said step of communicating said first digital value and said second digital value to said location involves the use of a cell phone.

19. The method of claim 16, wherein said hoist system includes an engine that powers said hoist system, and said first parameter varies as a function of a rotational speed of said engine.

* * * * *